US006244580B1

(12) United States Patent
Durfee, Jr.

(10) Patent No.: US 6,244,580 B1
(45) Date of Patent: Jun. 12, 2001

(54) MACHINING VISE

(75) Inventor: David L. Durfee, Jr., Meadville, PA (US)

(73) Assignee: Parlec, Inc., Fairport, NY (US)

( * ) Notice: Subject to any disclaimer, the term of this patent is extended or adjusted under 35 U.S.C. 154(b) by 0 days.

(21) Appl. No.: 09/172,011

(22) Filed: Oct. 14, 1998

(51) Int. Cl.[7] ..... B25B 5/16

(52) U.S. Cl. ..... 269/43; 269/271; 269/43; 269/136; 269/134

(58) Field of Search ..... 269/271, 43, 136, 269/134, 153, 154, 170, 215, 203, 137, 20, 138

(56) References Cited

U.S. PATENT DOCUMENTS

| | | | |
|---|---|---|---|
| 4,529,183 | 7/1985 | Krason et al. . | |
| 4,545,122 | 10/1985 | Durfee, Jr. . | |
| 4,736,935 | 4/1988 | Vasapolli . | |
| 4,923,186 | 5/1990 | Durfee, Jr. . | |
| 4,993,167 | 2/1991 | Durfee, Jr. . | |
| 5,037,075 | 8/1991 | Durfee, Jr. . | |
| 5,065,990 | 11/1991 | Durfee . | |
| 5,098,073 | 3/1992 | Lenz . | |
| 5,129,638 | 7/1992 | Durfee, Jr. . | |
| 5,133,135 | 7/1992 | Durfee, Jr. . | |
| 5,150,888 | 9/1992 | Durfee . | |
| 5,160,127 | 11/1992 | Lin . | |
| 5,161,787 | 11/1992 | Hobday . | |
| 5,163,662 | 11/1992 | Bernstein . | |
| 5,242,159 | 9/1993 | Bernstein . | |
| 5,505,437 | 4/1996 | Durfee, Jr. . | |
| 5,649,694 | 7/1997 | Buck . | |
| 5,720,476 | 2/1998 | Swann et al. . | |
| 5,921,534 | 7/1999 | Swann et al. . | |
| 5,984,290 * | 1/2000 | Durfee, Jr. | 269/43 |
| 6,017,026 * | 1/2000 | Durfee, Jr. | 269/271 |

* cited by examiner

*Primary Examiner*—Joseph J. Hail, III
*Assistant Examiner*—Lee Wilson
(74) *Attorney, Agent, or Firm*—Shlesinger, Fitzsimmons & Shlesinger

(57) ABSTRACT

A machining vise is disclosed. The machining vise includes a main body having a recess, a stationary vise jaw removably mounted at a mid-point on the main body, a first movable slide and a second movable slide mounted in the recess. A first vise jaw is mounted to the first movable slide and a second vise jaw is mounted to the second movable slide. The vise also includes a drive for moving the first and second movable slides, wherein a controlled release assembly associated with the first movable slide controls the movement of the first movable slide and the second movable slide. The controlled release assembly includes an offset adjustment mechanism and a spring biasing mechanism. The vise further includes a structure for releasably securing the vise jaws to the slides.

14 Claims, 6 Drawing Sheets

MACHINING VISE

CROSS-REFERENCE TO RELATED APPLICATION

The present application relates to the inventor's own U.S. patent application Ser. No. 08/988,700, entitled "Machining Vise", filed Dec. 11, 1997, which is incorporated herein by reference, and is now U.S. Pat. No. 6,017,026.

BACKGROUND OF THE INVENTION

1. Field of the Invention

The invention relates to two station machining vises. More particularly, the invention relates to two station machining vises facilitating easy replacement of jaws, a highly stable body, guaranteed alignment of a central block, and an efficient drive system.

2. Description of the Prior Art

Two station machining vises are known in the art. These stations permit an individual to non-simultaneously mount two work pieces on a single vise during the machining process. These vises are generally provided with great versatility to enhance the performance of the vise by limiting the effort required to use and modify the vise.

For example, many vises are known which include replaceable jaws to permit modification of the vise jaws when the vise is to be used with different work pieces. Many of these vises employ a knuckle on the vise slide which receives the replaceable vise jaw. As shown in Applicant's prior U.S. Pat. No. 5,505,437, entitled "TWO STATION MACHINING VISE WITH REMOVABLE AND OFFSET-TABLE JAWS", which is incorporated herein by reference, these knuckles include contoured surface which engages a pin mounted in the underside of the vise jaw.

While structures such as these provide secure attachment of the vise jaw to the knuckle, the incorporation of the pin with the vise jaw is expensive. When jaws are manufactured to engage a knuckle such as that disclosed in the '437 patent, the vise jaw must be drilled to include a hole through which the pin may be placed. Once the pin is properly secured within the vise jaw, the vise jaw is ready for use. This is an expensive and time consuming process that must be performed for each vise jaw to be used with a vise assembly employing the structure embodied in the '437 patent.

In addition, the main body of most two station machining vises is manufactured to include a recess into which the front and rear slides of the vise may be placed. Generally, the bodies are extruded with a central recess having only side walls, and the front and rear ends of the main body are left open. Unfortunately, these extruded main bodies do not stand up to the substantial stress placed on the vises, and ultimately the vises may bend out of alignment. When this occurs the vises is no longer useful, and the vise must be replaced. In addition, vises designed in this manner allow for vibrations while work pieces are being machined. The vibrations produce undesirable finishes on work pieces and excessive wear of the machining tools. This design also allows fluid and debris to enter the internal workings of the vise, causing it to fail or wear out earlier than anticipated.

It is often desirable to provided a two station vise in which the rear vise jaw does not move until the front vise jaw fully engages the work piece. This is generally accomplished by providing the rear slide with a braking assembly that resists the movement of the rear vise jaw until the front vise jaw fully engages the work piece. Many of these two station vises are also provided with offset assemblies that work with the brake assembly to create a initial predetermined offset of the rear jaw when a work piece is being removed therefrom.

Unfortunately, the braking assemblies and the offset assemblies employed by current two station vises employ many components to achieve their desired results. As a result, they are often cumbersome and very difficult to manufacture. Further, the many components employed in these braking assemblies and offset assemblies make them difficult to use, adjust and repair.

A need, therefore, exists for a two station vise that overcomes the shortcoming of the prior two station vises. The present invention provides such a two station vise.

SUMMARY OF THE INVENTION

It is, therefore, an object of the present invention to provide a machining vise. The vise a main body having a longitudinal axis, a stationary vise jaw mounted on the main body, and at least a first movable slide mounted in the main body for guiding a first movable vise jaw along the longitudinal axis. The first movable slide includes a first upwardly extending knuckle on which the first movable vise jaw is mounted. The first knuckle further includes a resiliently biased plunger shaped and dimensioned to engage the first movable vise jaw, wherein the resiliently biased plunger extends substantially perpendicularly to the longitudinal axis and engages the first movable vise jaw to releasably coupled the first movable vise jaw on the first knuckle. The vise also including a drive for moving the first movable slide.

It is also an object of the present invention to provide a machining vise wherein the first knuckle includes a pin adapted to engage a camming surface formed within the recess of the first movable vise jaw, and wherein the resiliently biased plunger and the pin engage the first movable vise jaw to releasable coupled the first movable vise jaw on the first knuckle.

It is a further object of the present invention to provide a machining vise wherein the pin is rotatably mounted to the first knuckle to ensure a proper connection to the camming surface formed within the recess of the first movable vise jaw.

It is another object of the present invention to provide a machining vise wherein the pin includes a flat surface shaped to engage the camming surface formed within the recess of the first movable vise jaw.

It is also an object of the present invention to provide a machining vise wherein the resiliently biased plunger includes first and second plunger members extending from opposite sides of the first knuckle.

It is a further object of the present invention to provide a machining vise wherein the resiliently biased plunger engages a camming surface formed within the recess of the first movable vise jaw causing the first movable vise jaw to be drawn downwardly under the pressure of the resiliently biased plunger.

It is another object of the present invention to provide a machining vise wherein the resiliently biased plunger includes first and second plunger members extending from opposite sides of the first knuckle, and the first and second plunger members respectively engage first and second camming surfaces formed with the recess of the first movable vise jaw causing the first movable vise jaw to be drawn downwardly under the pressure of the resiliently biased plunger.

It is also an object of the present invention to provide a machining vise including a main body having a recess, a stationary vise jaw removably mounted at a mid-point on the main body, a first movable slide and a second movable slide mounted in the recess. A first vise jaw is mounted to the first movable slide and a second vise jaw is mounted to the second movable slide. The vise also includes a drive for moving the first and second movable slides, wherein a controlled release assembly associated with the first movable slide controls the movement of the first movable slide and the second movable slide. The controlled release assembly includes an offset adjustment mechanism and a spring biasing mechanism.

It is a further object of the present invention to provide a machining vise wherein the controlled release assembly causes the first movable slide to release a work piece before the second movable slide releases a work piece.

It is another object of the present invention to provide a machining vise wherein the offset adjustment mechanism is formed within the main body and is associated with the first movable slide to limit movement of the first movable slide as a work piece is released from the machining vise.

It is also an object of the present invention to provide a machining vise wherein the offset adjustment mechanism includes a stationary screw member and a stop block threaded thereto, the stop block being moved by rotation of the stationary screw member to adjust an offset distance.

It is a further object of the present invention to provide a machining vise wherein the spring biasing mechanism includes at least one spring and a stationary retainer plate, and the spring and stationary retainer plate force the first movable slide away a predetermined offset distance before the first movable slide engages the offset adjust mechanism and the second movable slide begins to move for the release of a work piece.

It is another object of the present invention to provide a machining vise wherein the first vise jaw is removably mounted to the first movable slide and the second vise jaw is removably mounted to the second movable slide.

It is a further object of the present invention to provide a machining vise the drive includes a drive screw.

It is another object of the present invention to provide a machining vise wherein the drive screw includes a proximal end and a distal end, and the distal end is threaded to engage a threaded opening in the second movable slide to thereby control movement of the second movable slide within the main body.

It is also an object of the present invention to provide a machining vise wherein the drive screw includes a flange member which engages the first movable slide to move the first movable slide within the main body as the drive screw is rotated.

It is a further object of the present invention to provide a machining vise wherein rotation of the drive screw causes the second movable slide to move until the second movable slide engages a work piece and thereafter continued rotation causes the flange member to engage the first movable slide to move the first movable slide engages a work piece.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
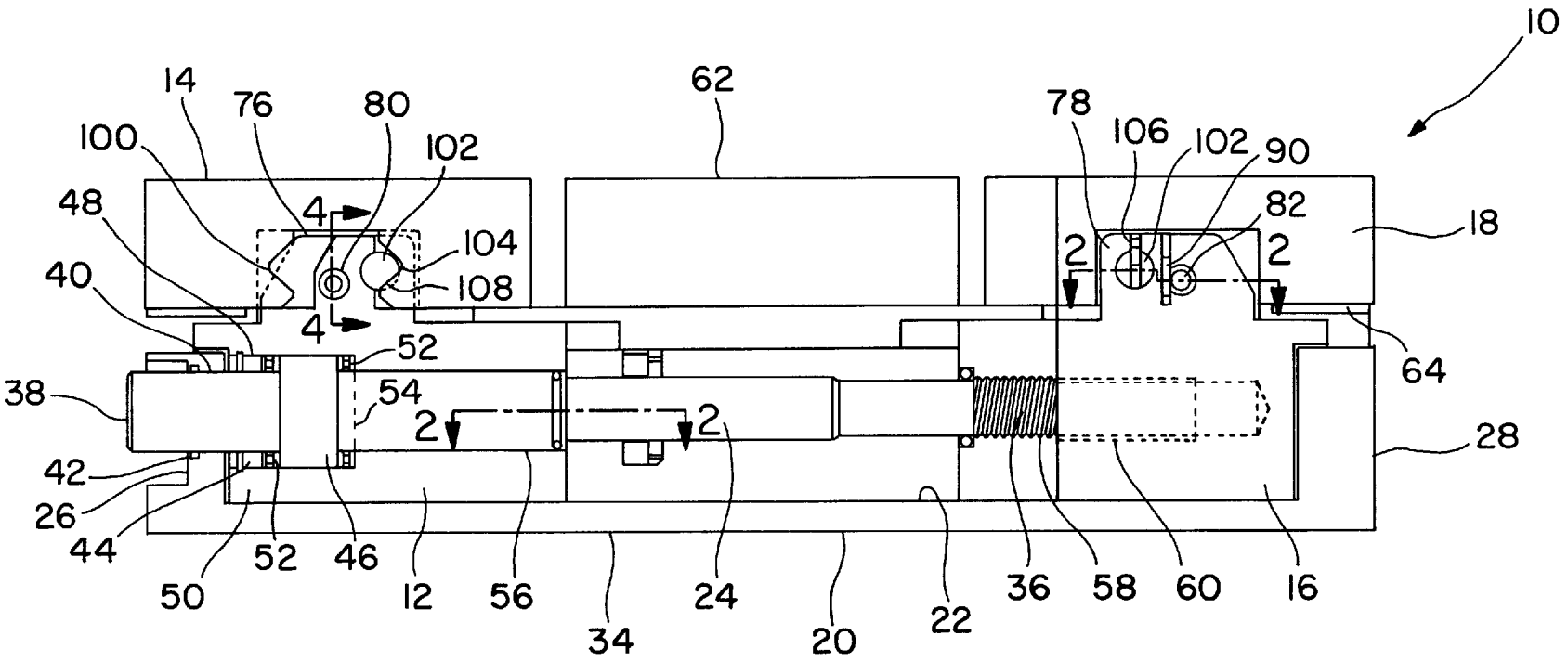
FIG. 1 is a side cross sectional view of the present machining vise taken along the Section A—A in FIG. 2.

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 through 6, a two station machining vise 10 is disclosed. The present machining vise 10 is designed to provide controlled movement of both a first front slide 12/vise jaw 14 and a second rear slide 16/vise jaw 18 such that the front slide 12/vise jaw 14 moves to engage a work piece only after the rear slide 16/vise jaw 18 has fully engaged a work piece. Upon release, however, the front slide 12/vise jaw 14 moves a predetermined offset distance before the rear slide 16/vise jaw 18 begins its movement to release an engaged work piece.

The machining vise 10 includes a main body 20 provided with a recess 22 for housing the drive assembly 24 of the machining vise 10 and guiding the movable front and rear slides 12, 16 therein. The main body 20 is preferably manufactured from a single aluminum block with its core removed to create the recess 22. The recess 22 is substantially rectangular with straight upstanding walls. The shape of the recess 22 permits the drive assembly 24 to be placed within the main body 20 in a manner that will be discussed in greater detail below.

As such, the recess 22 is defined by a forward wall 26, a rear wall 28, a pair of side walls 30, 32 and a bottom wall 34. The unitary design of the main body is resistant to deformation caused by the forces placed upon the machining vise. As such, the main body will stand up to the great forces encountered during the machining process and retain its shape to optimize movement of the drive assembly therein. Various openings and slots may be formed in the main body to accommodate components of the present vise in a manner that will be discussed in greater detail below. It should be noted that the main body is substantially the same as the main body disclosed in the inventor's own U.S. patent application Ser. No. 08/988,700, entitled "Machining Vise", filed Dec. 11, 1997, which is incorporated herein by reference.

The front slide 12 and a rear slide 16 are mounted within the recess 22 for guiding the movable vise jaws 14, 18. The front slide 12 and the rear slide 16 are connected by a drive screw 36 used to move the front and rear slides 12, 16 in a controlled manner. Specifically, the drive screw 36 is a continuous member and includes a proximal end 38 passing through an opening 40 formed in the forward wall 26 of the main body 20. The proximal end 38 of the drive screw 36 is positioned within the opening 40 for rotation (for example, by a hex handle) therein. An o-ring 42 seals the drive screw 36 within the opening 40 in the forward wall 26 to prevent contamination, while allowing radial and lateral movement of the drive screw 36. Rotational movement and positioning of the drive screw 36 is further enhanced by the provision of a main screw retainer ring 44 positioned between the opening 40 and the flange member 46 of the drive screw 36.

The proximal end 38 of the drive screw 36 is supported adjacent the forward wall 26 of the main body 20 within a cavity 48 formed within the proximal end 50 of the front slide 12. The drive screw 36 is retained within the cavity 48 by the main screw retainer ring 44 located adjacent the opening 40 in the forward wall 26 of the main body 20. The drive screw 36 is further supported within the cavity by first and second bearings 52, constituting the main screw bearing assembly, positioned on opposite sides of a flange member 46 formed on the drive screw 36 within the cavity 48. The flange member 46 is sized to engage the distal wall 54 of the cavity 48 in a manner that will be discussed in greater detail.

The proximal end 38 of the drive screw 36 is supported within the front slide 12 for rotational movement therein. The proximal end 38 of the drive screw 36 is supported within the cavity 48 formed in the front slide 12 in the manner discussed above and extends through a passage 56 formed in the front slide 12 to engage the rear slide 16. The distal end 58 of the drive screw 36 is threaded to engage a female screw shaft opening 60 of the rear slide 16. In this way, rotation of the drive screw 36 either causes the front slide 12 or the rear slide 16 to move in a manner that will be discussed in greater detail below.

In use, clamping rotation of the drive screw 36 will first draw the rear slide 16 and vise jaw 18 into engagement with a work piece, securing the work piece between the rear vise jaw 18 and the stationary vise jaw 62. Once the work piece is fully engaged and the drive shaft 36 is further rotated, the flange member 46 will be moved toward the distal wall 54 of the front slide 12. When the flange member 46 engages the distal wall 54, the front slide 12 and vise jaw 14 will be forced into engagement with a work piece, securing the work piece between the front vise jaw 14 and the stationary vise jaw 62.

The recess 22 and the drive assembly 24 stored therein are protected from debris and various contaminates by a top plate 64 releasably secured to the main body 20. The top plate 64 is secured in a manner substantially identical to the manner disclosed in the inventor's own U.S. patent application Ser. No. 08/988,700, entitled "Machining Vise", filed Dec. 11, 1997, which is incorporated herein by reference. Specifically, and with reference to FIG. 5, the top plate 64 fits over the recess 22 and includes openings permitting appropriate attachment of the first and second vise jaws 14, 18 respectively to the front and rear slides 12, 16, as well as permitting the releasable attachment of the stationary center vise jaw 62.

The top plate 64 is held in position by a series of bolts (only one shown) including first and second center jaw mounting studs 66. The center jaw mounting studs 66 are provided with both male threading and female threading. In this way, they may be used to securely attach the top plate 64 to the main body 20, while also providing a female thread for allowing the attachment of the center vise jaw 62 to the main body 20. Specifically, the center jaw mounting studs 66 are respectively passed through openings in the top plate 64 and screwed into mounting holes 68 formed in the main body 20 for receiving the center jaw mounting bolts 70 (only one shown).

Proper positioning of the center jaw mounting studs 66 is ensured by providing a tapered collar 72 on each of the center jaw mounting studs 66. The tapered collar 72 is designed to engage a tapered surface 74 on the opening of the top plate 64. Engagement of the tapered collar 72 and the tapered surface 74 on the opening of the top plate 64 ensures that the center jaw mounting studs 66 extend upwardly in an ideal position for receipt of the center jaw 62.

Once the center jaw mounting studs 66 are properly received in the main body 20 and the top plate 64, the stationary center jaw 62 is releasably coupled thereto. Center jaw mounting bolts 70 are passed through the center jaw 62 and into the respective female threaded portions of the center jaw mounting studs 66 to releasably couple the center jaw 62 on the main body 20.

As discussed above, the top plate 64 is provided with openings shaped and dimensioned to permit respective attachment of the front and rear vise jaws 14, 16 to the front and rear slides 12, 16. Each of the front and rear slides 12, 16 are, therefore, provided with upwardly extending knuckles 76, 78 shaped and dimensioned to releasably secure the front and rear vise jaws 14, 18 to the front and rear slides 12, 14.

The front and rear knuckles 76, 78 will now be described with reference to FIGS. 1 through 4. Since the knuckles are mirror images of each other, any reference to specific components of one knuckle should be understood to refer to the similar components of the other knuckle.

Specifically, the front knuckle 76 extends from the upper surface of the front slide 12 and through the top plate 64. The front knuckle 76 includes first and second resiliently biased jaw retainer plungers 80, 82 extending from opposite lateral sides of the front knuckle 76. The first and second resiliently biased jaw retainer plungers 80, 82 are outwardly biased by a jaw retainer plunger assembly spring 84. The first and second resiliently biased jaw retainer plungers 80, 82 are respectively held within a lateral channel 86 formed in the front knuckle 76 by an abutment 88 formed adjacent a first end of the lateral channel 86 and a retaining pin 90 positioned adjacent the second end of the lateral channel 86. The retaining pin 90 engages an abutment member 92 formed on the second resiliently biased jaw retainer plunger 82 to maintain the plunger within the lateral channel 86. In this way, the first and second resiliently biased jaw retainer plungers 80, 82 outwardly extend to engage the front vise jaw 14 onto the front knuckle 76.

The first and second resiliently biased jaw retainer plungers 80, 82 respectively engage the camming surface 94 of the tapered recesses 96 formed along the inner surface of the front vise jaw 14. The first and second resiliently biased jaw retainer plungers 80, 82 engage the lower portions of the tapered recesses 96 drawing the front vise jaw 14 downward as it is engaged by the first and second resiliently biased jaw retainer plungers 80, 82.

The front knuckle 76 also includes first and second projections 98 shaped and dimensioned to engage jaw recesses 100 formed along the inner surface of the front vise jaw 76. The front knuckle 76 is also provided with a pin 102 along its second side. The pin 102 is substantially similar to the pin disclosed in the inventor's own prior U.S. patent application Ser. No. 08/988,700, entitled "Machining Vise", filed Dec. 11, 1997, which is incorporated herein by reference. Briefly, the pin 102 is removably formed with the front knuckle 76, and is shaped and dimensioned to engage a camming surface 104 formed along the inner surface of the front vise jaw 76. The pin 102 is held in position by a retainer pin 106. The retainer pin 106 is pressed or screwed into the knuckle and holds the pin 102 in position such that it is rotatable mounted to the front knuckle 76. This permits the pin 102 to rotate such that a flat surface 108 on the pin 102 aligns with the camming surface 104 on the inner surface of the front vise jaw 14. In use, the first and second resiliently biased jaw retainer plungers 80, 82 and the pin 102 engage the front vise jaw 14 to releasably couple the front vise jaw 14 on the front knuckle 76.

As with the front knuckle, the rear knuckle 78 extends from the upper surface of the rear slide 16 and through the top plate 64. As with the first knuckle 76, the rear knuckle 78 includes first and second resiliently biased jaw retainer plungers 80, 82 on opposite sides. The first and second resiliently biased jaw retainer plungers 80, 82 are shaped and dimensioned to engage a recess 96 formed along the inner surface of the rear vise jaw 18. The first and second jaw retainer plungers 80, 82 are respectively constructed from spring biased detent pins held within a lateral channel 86 extending through the second knuckle 78 in the same manner as the first and second resiliently biased jaw retainer plungers 80, 82 of the front knuckle 76.

The rear knuckle 78 is also provided with a pin 102 along its second side. The pin 102 is integrally formed with the rear knuckle 78, and is shaped and dimensioned to engage a camming surface 104 formed along the inner surface of the rear vise jaw 18. The pin 102 is rotatable mounted to the rear knuckle 78 to permit rotation therein such that a flat surface 108 on the pin aligns with the camming surface 104 on the inner surface of the rear vise jaw 18. In use, the resiliently biased jaw retainer plungers 80, 82 and the pin 102 engage the rear vise jaw 18 to releasable coupled the rear vise jaw 18 on the rear knuckle 78.

Since the pins 102 of the first and second knuckles 76, 78 are subjected to substantial wear as a result of the attachment and removal of different vise jaws, the pins 102 may be manufactured from a material which is harder than the other materials from which the front and rear slides 12, 16 are manufactured. In this way, wear of the knuckles will be reduced, providing a longer life for the present machining vise. In addition, the pin 102 may be readily replaced by removing the retainer pin 106 when the pin 102 is worn or damaged. In this way the present invention permits ready replacement of the pin, thereby avoiding expensive replacement of the entire slide assembly.

The pins 102 are also shaped and positioned to engage a camming surface 104 on the vise jaws 14, 18 such that when the vise jaws 14, 18 tighten down on a work piece the pressure forces the vise jaws 14, 18 downwardly against the top plate 64 and into secure engagement with the knuckles 76, 78. The secure attachment of the vise jaws 14, 18 to the knuckles 76, 78 is thereby ensured. The front and rear vise jaws 14, 18 are removed from the respective front and rear slides 12, 16 by positioning a thin pry bar within a jaw pry slot 110 and forcing the vise jaws 14, 18 from the knuckles 76, 78 when upward pressure is applied by the pry bar.

Figure 2:
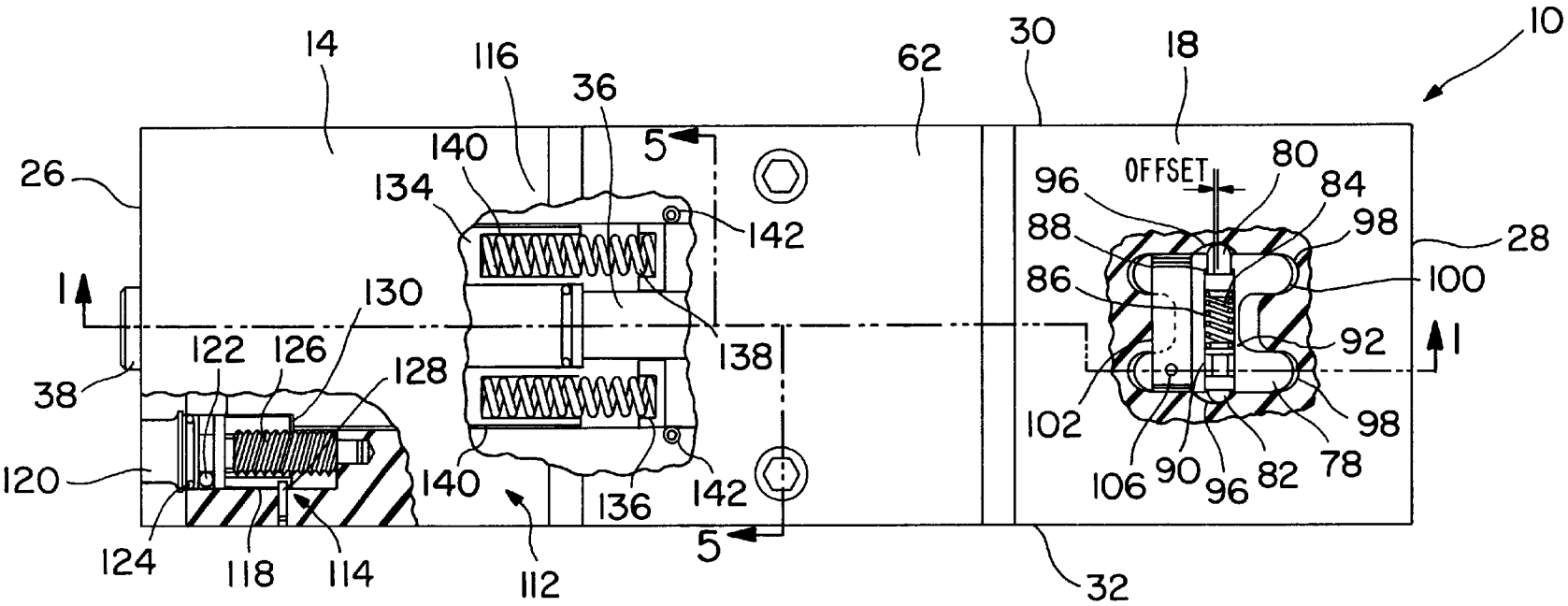
FIG. 2 is a top partial cross sectional view showing various internal components of the present machining vise taken along Section C—C in FIG. 4, Section E—E in FIG. 1, and Section J—J in FIG. 1.
Figure 3:
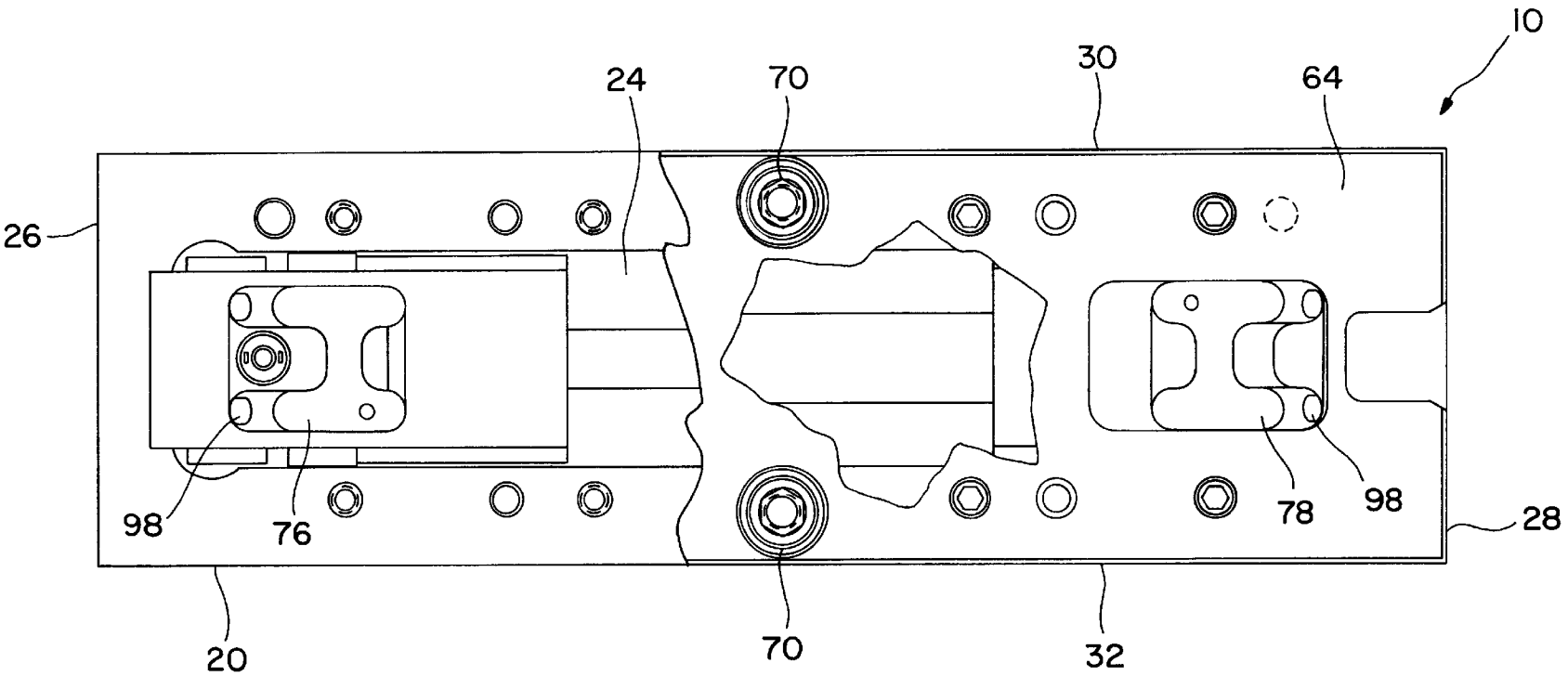
FIG. 3 is a top view of the present machining vise with the vise jaws removed.
Figure 4:
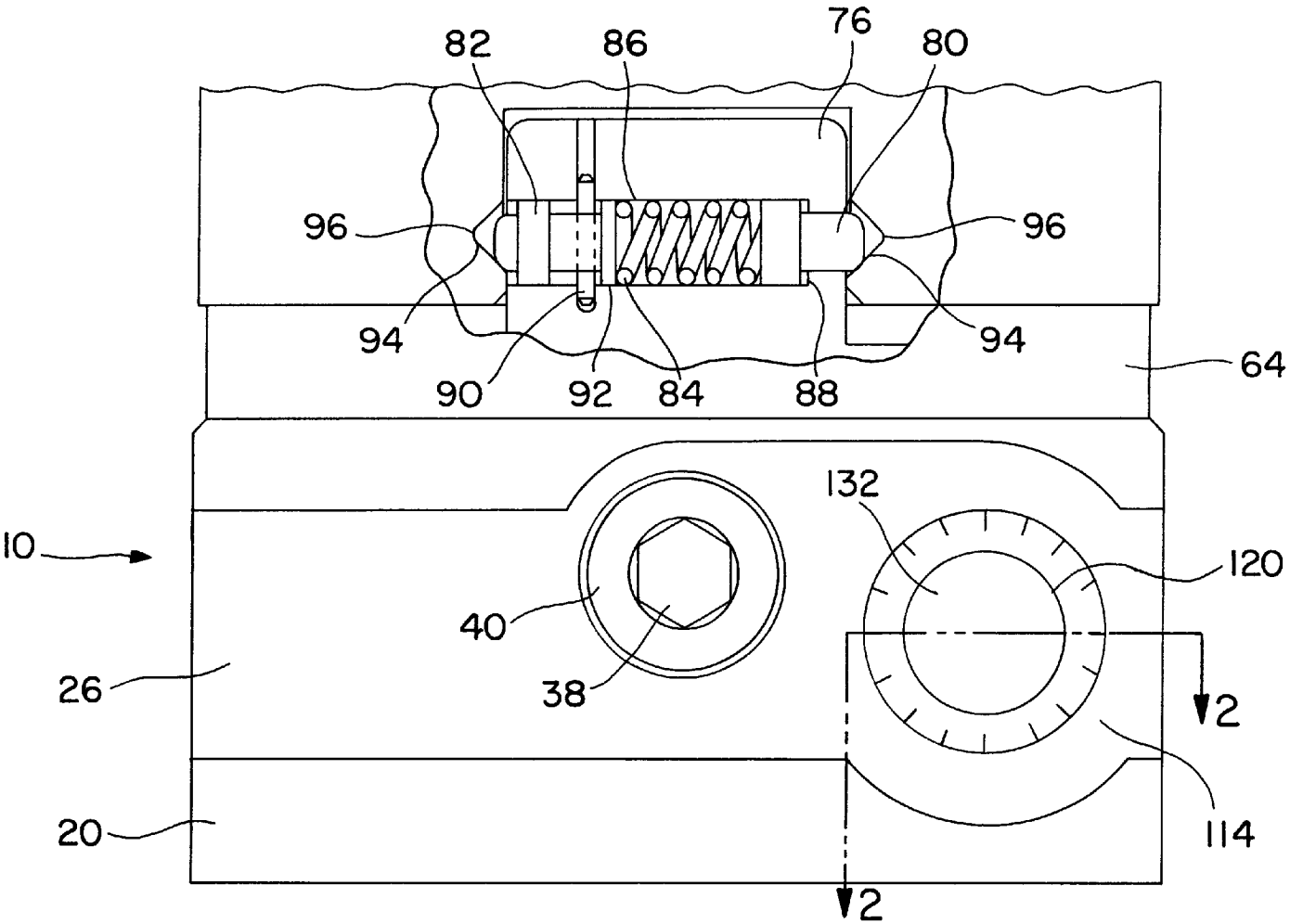
FIG. 4 is a front partial cross view of the present machining vise taken along the Section D—D in FIG. 1.
Figure 5:
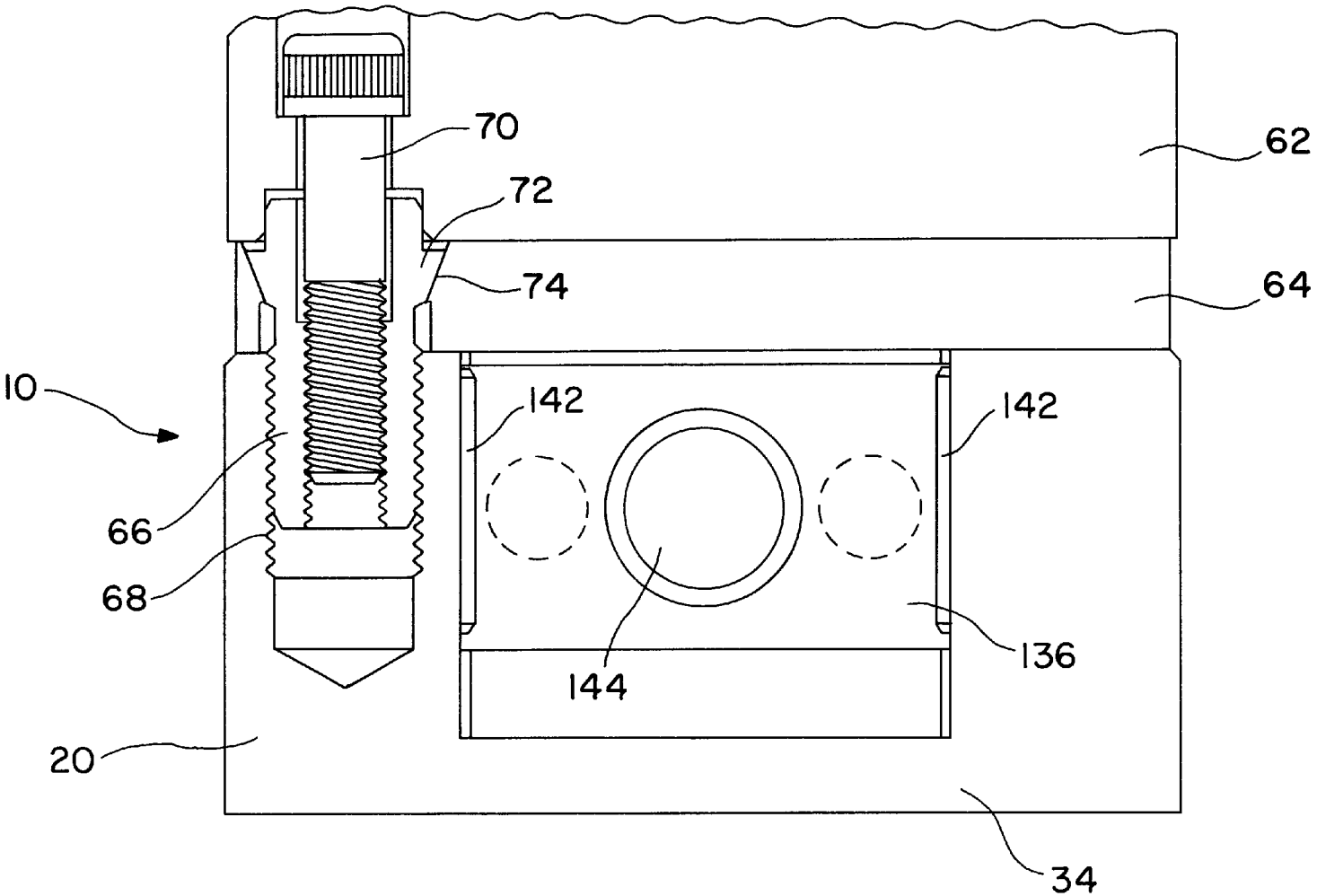
FIG. 5 is a cross sectional view of the present machining vise taken along the Section B—B in FIG. 1.
Figure 6:
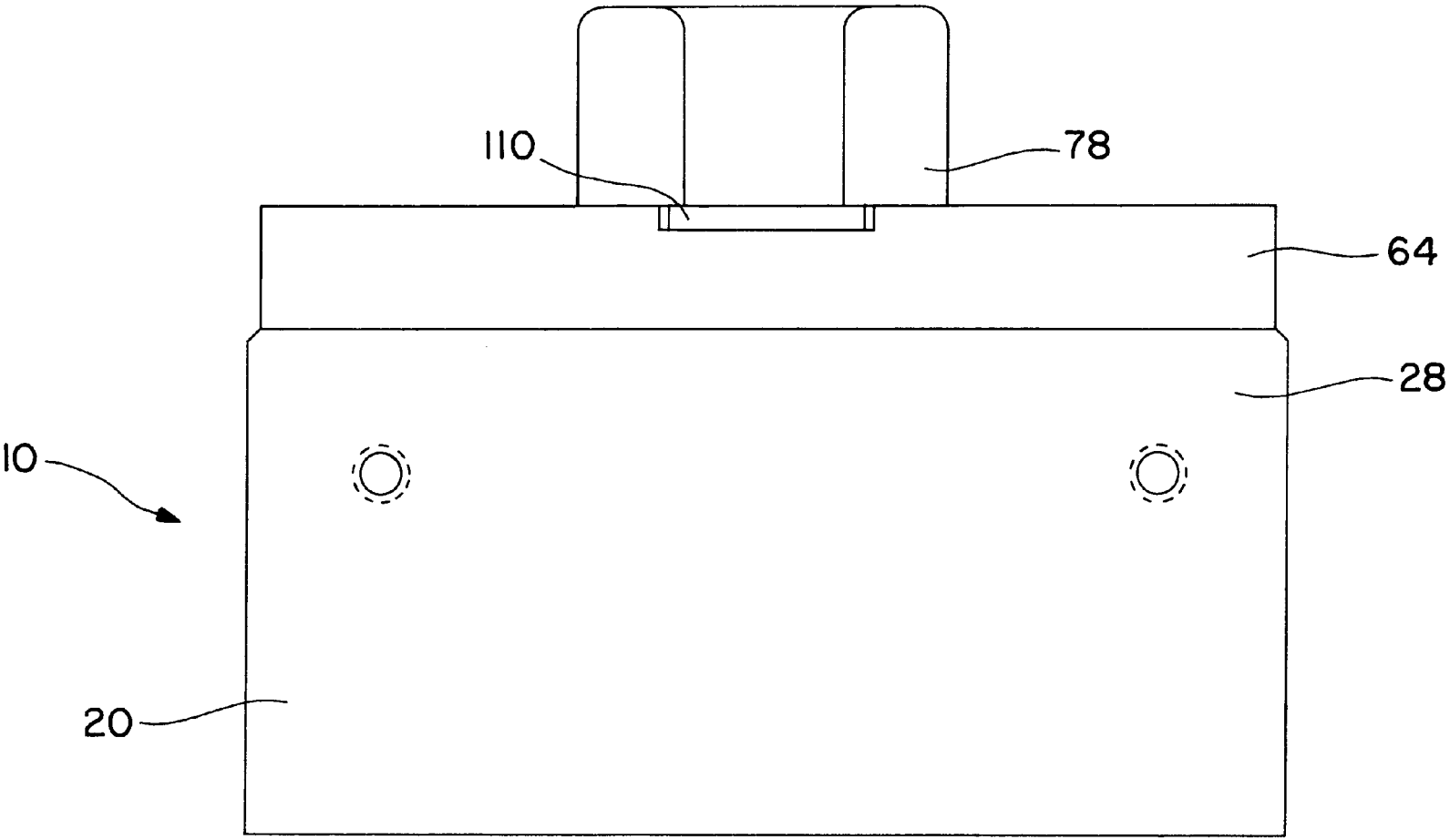
FIG. 6 is a rear view of the present machining vise.

With reference to FIGS. 1, 2 and 4, the controlled movement of the front slide 12 relative to the rear slide 16 is created by the provision of a controlled release assembly 112 associated with the drive screw 36, and intimately associated with the front slide 12. The controlled release assembly 112 is designed to provide controlled offset movement of the front slide 12 before the rear slide 16 moves to release a work piece.

The controlled release assembly 112 includes an offset adjustment mechanism 114 and a spring biasing mechanism 116. The offset adjustment mechanism 114 is housed within a recess 118 formed in the main body 20 of the machining vise 10 adjacent the front slide 12. The offset adjustment mechanism 114 controls the offset release displacement of the front slide 12 before the rear slide 14 is permitted to release from the work piece. The offset adjustment mechanism 114 includes a stationary control screw 120 held within the recess 118 by a stationary control screw retainer pin 122. A gasket 124 is also provided to seal the recess 118. The stationary support screw 120 supports an internally threaded offset stop block 126 which is longitudinally moveable within the recess 118. A offset stop block key pin 128 engages the stop block 126 to permit movement of the stop block 126 when the stationary screw 120 is rotated.

The stop block 126 is positioned such that it will engage the proximal end 50 of the front slide 12 and prevent further movement upon engagement. With this in mind, the proximal end 50 of the front slide 12 is provide with a recessed groove 130 shaped and dimensioned to selectively engage the stop block 126 as the front slide 12 moves proximally within the main body 20. By providing a stationary control screw 120 and an internally threaded stop block 126 an operator may adjust the offset adjustment mechanism 114 to an infinite number of desired positions. Controlled movement of the offset adjustment mechanism 114 is ensured by the provision of an external offset scale 132 indicating to the operator the position of the stop block 126 based upon the rotational position of the stationary control screw 120.

Controlled release of the first slide 12 is further permitted by the provision of a spring biasing mechanism 116 positioned between the distal end 134 of the front slide 12 and a stationary spring retainer plate 136 mounted within the main body 20 of the vise 10. The spring biasing mechanism 116 includes a pair of springs 138 positioned between recesses 140 formed in the distal end 134 of the front slide 12 and the stationary spring retainer plate 136. The stationary spring retainer plate 136 is securely held in position by retaining pins 142 secured between the main body 20 and the stationary spring retainer plate 136. The spring retainer plate 136 includes a central opening 144 through which the drive screw 36 may pass as it extends toward the rear slide 16.

Use of the present machining vise will now be described. Once work pieces are properly positioned and ready for attachment to the machining vise 10, the drive screw 36 is rotated. Rotation of the drive screw 36 initially causes the rear slide 16 and vise jaw 18 to move into engagement with the work piece. Once the work piece is engaged, the flange member 46 on the front slide 12 engages the distal wall 54 of the cavity 48 of the front slide 12 and the front slide 12 and vise jaw 14 commence movement to engage the respective work piece. In doing so, however, the spring biasing mechanism 116 is compressed, loading the first and second springs 138 with sufficient pressure to cause rearward movement of the front slide 12 during disengagement.

When action is taken to open the vise jaws, the front slide 12 and vise jaw 14, as a result of the spring biasing mechanism 116, are caused to open a predetermined offset distance as controlled by the offset adjustment mechanism 114. Specifically, as the drive screw 36 is rotated to release the work pieces, the spring biasing mechanism 116 forces the front slide 12 and vise jaw 14 to move proximally, opening the vise jaws. Eventually, the proximal end 50 of the front slide 12 engages the stop block 126 of the offset adjustment mechanism 114. As discussed above, the offset permitted with the front slide 12 is controlled by rotating the control screw 120 to position the stop block 126 at desired offset locations. At this time, movement of the front slide 12 is stopped and further rotation of the drive screw 36 causes the second slide 16 to move distally and open the second vise jaw 18 for release of the work piece held therein.

While the preferred embodiment has been shown and described, it will be understood that there is no intent to limit the invention by such disclosure, but rather, is intended to cover all modifications and alternate constructions falling within the spirit and scope of the invention as defined in the appended claims.

What is claimed is:

1. A machining vise, comprising:

a main body having a recess;

a stationary vise jaw removably mounted at a mid-point on the main body;

a first movable slide and a second movable slide mounted in the recess, wherein a first vise jaw is mounted to the first movable slide and a second vise jaw is mounted to the second movable slide;

means for moving the first and second movable slides;

a controlled release assembly associated with the first movable slide to control the movement of the first movable slide and the second movable slide, the controlled release assembly including an offset adjustment mechanism and a spring biasing mechanism.

2. The machining vise according to claim 1, wherein the controlled release assembly causes the first movable slide to release a work piece before the second movable slide releases a work piece.

3. The machining vise according to claim 1, wherein the offset adjustment mechanism is formed within the main body and is associated with the first movable slide to limit movement of the first movable slide as a work piece is released from the machining vise.

4. The machining vise according to claim 3, wherein the offset adjustment mechanism includes a stationary screw member and a stop block threaded thereto, the stop block being moved by rotation of the stationary screw member to adjust an offset distance.

5. The machining vise according to claim 3, wherein the spring biasing mechanism includes at least one spring and a stationary retainer plate, and the spring and stationary retainer plate force the first movable slide away a predetermined offset distance before the first movable slide engages the offset adjust mechanism and the second movable slide begins to move for the release of a work piece.

6. The machining vise according to claim 5, wherein the first vise jaw is removably mounted to the first movable slide and the second vise jaw is removably mounted to the second movable slide.

7. The machining vise according to claim 1, wherein the spring biasing mechanism includes at least one spring and a stationary retainer plate, and the spring and stationary retainer plate force the first movable slide away a predetermined offset distance as the means for moving is actuated to release a work piece.

8. The machining vise according to claim 1, wherein the first vise jaw is removably mounted to the first movable slide and the second vise jaw is removably mounted to the second movable slide.

9. The machining vise according to claim 1, wherein the means for moving includes a drive screw.

10. The machining vise according to claim 9, wherein the drive screw includes a proximal end and a distal end, and the distal end is threaded to engage a threaded opening in the second movable slide to thereby control movement of the second movable slide within the main body.

11. The machining vise according to claim 10, wherein the drive screw includes a flange member which engages the first movable slide to move the first movable slide within the main body as the drive screw is rotated.

12. The machining vise according to claim 11, wherein rotation of the drive screw causes the second movable slide to move until the second movable slide engages a work piece and thereafter continued rotation causes the flange member to engage the first movable slide to move the first movable slide engages a work piece.

13. The machining vise according to claim 12, wherein the controlled release assembly causes the first movable slide to release a work piece before the second movable slide releases a work piece.

14. A machining vise, comprising:

a main body having a longitudinal axis;

a stationary vise jaw mounted on the main body;

at least a first movable slide mounted in the main body for guiding a first movable vise jaw along the longitudinal axis, the first movable slide including a first upwardly extending knuckle on which the first movable vise jaw is mounted;

the first knuckle includes a pair of resiliently biased plungers shaped and dimensioned to engage the first movable vise jaw, said resiliently biased plungers extending substantially perpendicularly to said longitudinal axis and engaging the first movable vise jaw to releasably couple the first movable vise jaw on the first knuckle; and means for moving the first movable slide, said resiliently biased plungers extending from opposite sides of said first knuckle, and resiliently engaging first and second camming surfaces formed in a recess in the first movable vise jaw and causing the first movable vise jaw to be drawn downwardly under the pressure of the resiliently biased plungers.

* * * * *